US005186346A

United States Patent [19]

Calvert

[11] Patent Number: 5,186,346

[45] Date of Patent: Feb. 16, 1993

[54] CONTAINER

[75] Inventor: John H. Calvert, Manchester, United Kingdom

[73] Assignee: Cussons (International) Limited, Manchester, England

[21] Appl. No.: 855,235

[22] Filed: Mar. 23, 1992

[30] Foreign Application Priority Data

Mar. 26, 1991 [GB] United Kingdom ..... 9106420

[51] Int. Cl.[5] ..... B65D 85/00

[52] U.S. Cl. ..... 220/212.5; 220/751; 206/806

[58] Field of Search ..... 220/212, 379, 744, 94 R, 220/94 A, 212.5, 751; 215/228, 100 A, 101; 206/806

[56] References Cited

U.S. PATENT DOCUMENTS

| | | | |
|---|---|---|---|
| 1,988,962 | 1/1935 | Racine et al. | 206/806 X |
| 2,085,979 | 7/1937 | Hothersall | 206/806 X |
| 3,119,541 | 1/1964 | Lynn | 206/806 X |
| 3,240,384 | 3/1966 | Lermer | 206/806 X |
| 3,255,930 | 6/1966 | Woodard | 220/212 X |
| 3,495,797 | 2/1970 | Ganz | 206/806 X |
| 3,817,371 | 6/1974 | Gatter | 206/806 X |
| 4,712,671 | 12/1987 | Salacuse | 220/212 X |
| 4,883,175 | 11/1989 | Thiele et al. | 215/101 X |

FOREIGN PATENT DOCUMENTS 2098958 12/1982 United Kingdom .

*Primary Examiner*—Allan N. Shoap
*Assistant Examiner*—Nova Stucker
*Attorney, Agent, or Firm*—Salter, Michaelson & Benson

[57] ABSTRACT

A container (10) particularly for shampoo or shower gel having a cap (22) which removably covers a dispensing outlet (20) at one end (12) of the container. The cap is provided with a hook (34) which is movable from a first position in which it lies along or below the surface of the cap and a second position in which it projects from the cap surface. In use the cap is fitted to the bottom (24) of the container and with the hook in the second position the container can be suspended upside down.

12 Claims, 2 Drawing Sheets

CONTAINER

This invention relates to a container and more particularly but not exclusively a container for a washing aid such as shampoo shower gel and the like.

It has become the practice to provide containers that are to be used in showers with means for suspending the container for example from a tap, curtain rail, or other convenient fitting. One of the earliest arrangements comprised a flexible loop which was made as a separate item and then fixed to the container. There are two disadvantages with this. The first is that a loop can only be hung over a protrusion such as a tap and the container cannot be suspended from a ledge in the shower, or rail, or from the top of the shower wall. The second and possibly more important disadvantage is that fitting the loop to the container is an additional production step which adds to the overall cost of the product.

In order to deal with the first disadvantage a container has been developed which includes a separately formed hook fitted thereto. It will be appreciated that this product still suffers from the second disadvantage mentioned above.

The next development was to form an integral hook on the container. The hook was provided on the bottom of the container so that it was suspended upside down in the shower. A different problem was created in that the container could not be stood on its bottom and for filling special provision had to be made to hold the container the right way up. This disadvantage was overcome by the container described in UK Patent Specification No. 2098958 in which an integral hook is provided on a cap fitted to the top of the container and concealing a dispensing valve. In use the cap is removed from the top of the container and fitted to the bottom thereof so that the container can be suspended upside down, that is to say with the dispensing valve directed downwardly. This arrangement deals with the problem of filling the container with an integral hook fixed to the bottom thereof.

However, there is yet another problem. Integral hooks on containers make them occupy additional space during storage, transport and display at the point of sale. All of that is economically disadvantageous. In addition the container with an integral hook is aesthetically unattractive, this being an important factor in competitive retail selling.

The present invention has been made in order to deal with these problems.

According to the invention there is provided a container having a top and a bottom, dispensing means provided at the top of the container, a cap removably fixable to the top of the container to cover the dispensing means, said cap also being removably fixable to the bottom of the container and a hook fixed to the cap and movable between a first position in which the hook extends along or below the surface of the cap and a second position in which the hook projects from the cap.

In a preferred embodiment of the invention the free end of the hook is provided with a barb, there being an aperture in the cap for receiving the barb when the hook is in the first position.

A specific embodiment of the invention will now be described by way of example with reference to the accompanying drawings in which.

Figure 1:
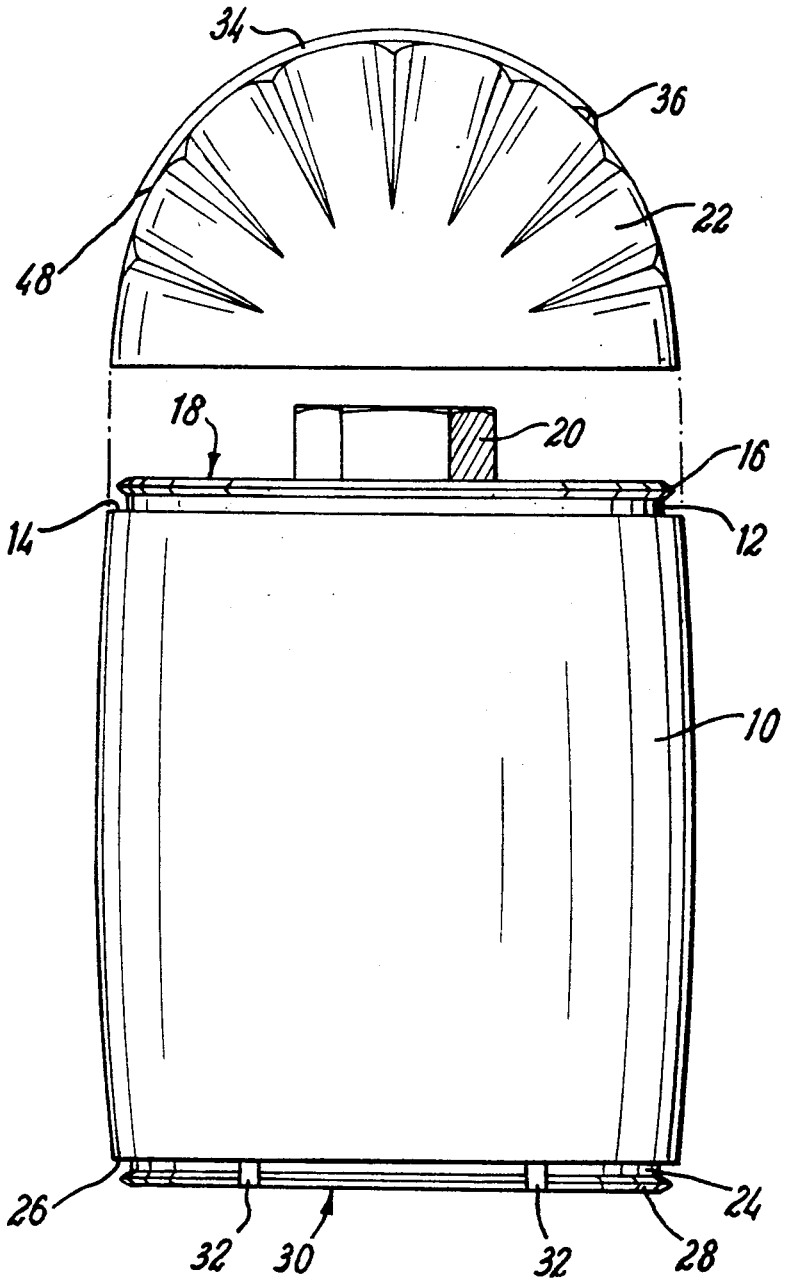
FIG. 1 shows the container in side elevation in the storage position and with the cap "exploded"

Referring to the drawings the container comprises a hollow body 10 which is preferably of moulded plastics. The top 12, of the body is of slightly reduced dimensions so as to define a shoulder 14. A lip 16 is provided adjacent the top face 18 and a dispensing valve 20 projects from said top face. A hollow cap 22 is adapted to be received on the reduced top part 12 so as to rest on the shoulder 14, the lip 16 holding the cap onto the container body. With the cap fitted to the top and concealing the dispensing valve, the assembly is in the condition for transport, storage and display for sale.

The bottom 24 of the body, like the top, is also of reduced dimensions defining a shoulder 26. A lip 28 is provided adjacent the bottom face 30. Water drainage channels 32 which extend from the face 30 to the shoulder 26 are provided at intervals around the reduced bottom part 24.

Figure 3:
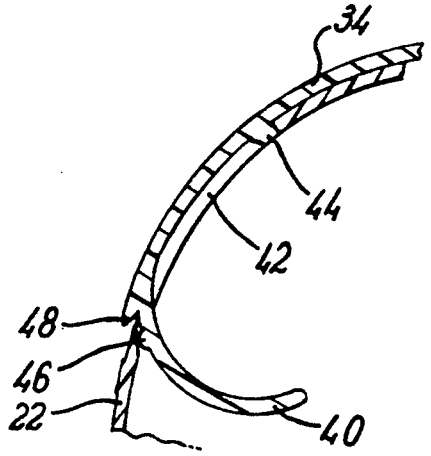
FIG. 3 is a part section through the cap.
Figure 2:
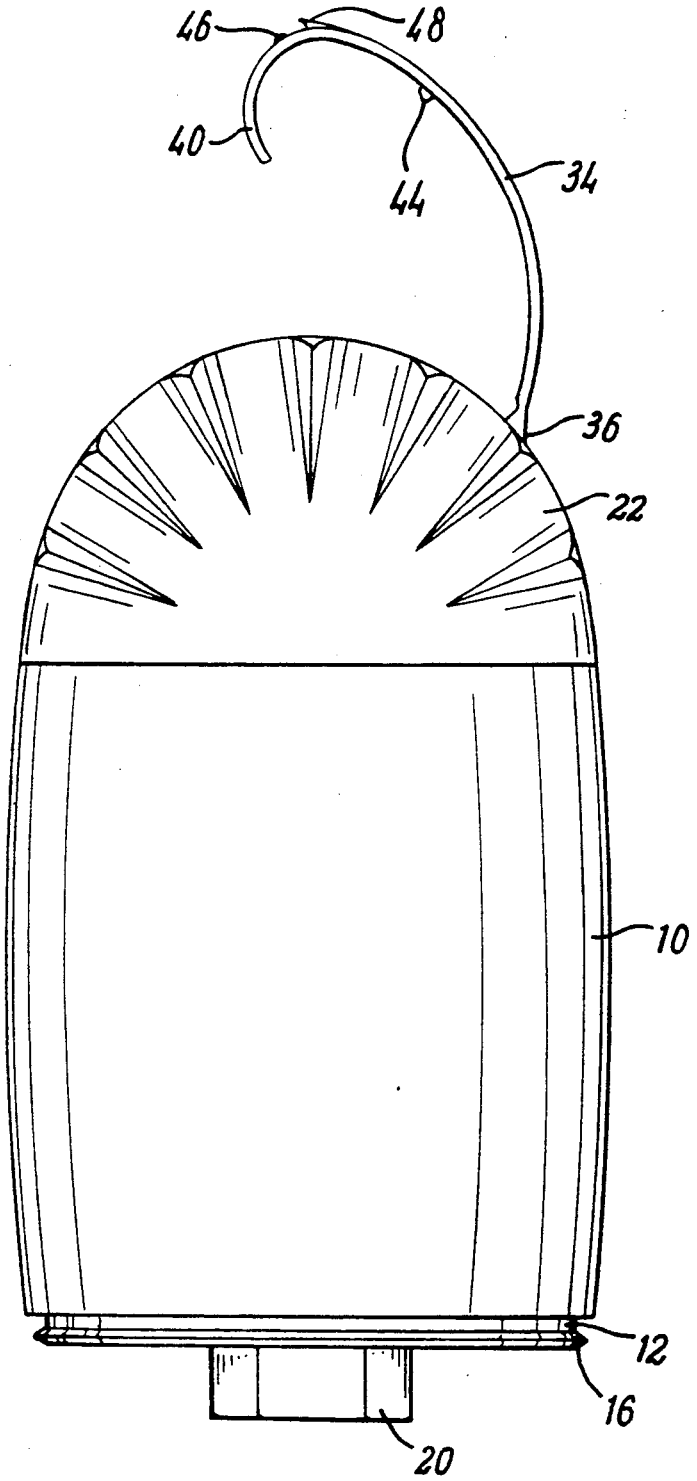
FIG. 2 shows the container of FIG. 1 in side elevation and in the use position.

The cap is provided with a hook 34 which is connected to the cap by an integral hinge 36. The hook is of generally arcuate shape to match the exterior of the cap so that, as illustrated in FIG. , it can lie along the surface of the cap in the "closed" position. As can be seen in FIGS. 2 and 3 the free end 40 of the hook is of sharply reduced radius so as to form a fluke or barb. An aperture 42 is formed in the cap wall through which the free end 40 projects when the hook is in the said closed position shown in FIG. I and as can be seen in FIG. 3.

The hook is provided with a rib 44 on the concave surface thereof. The rib 44 engages the edge of the aperture 42 when the hook is in the closed position thereby helping to ensure that the hook is held closely to the surface of the cap. In addition the aforesaid engagement of the rib 44 with the edge of the aperture 42 ensures that a lip 46 on the convex side of the hook engages the inner surface of the cap just adjacent the aperture thereby retaining the cap in the closed position.

A small tab 48 is also formed on the convex side of the hook close to the lip 46 and such that it is externally accessible when the hook is in the closed position. By lifting the tab the lip and rib can be disengaged from the cap and the hook moved to the "open" position as illustrated in FIG. 2.

When the container is to be used, for example in a shower, the cap is removed from the top, the body is inverted and the cap then fitted to the bottom. The hook is moved from the closed to the open position so that the container can be suspended upside down for dispense of the contents.

It will be appreciated that when the hook is in the open position as shown in FIG. 2 the aperture 42 is uncovered and water, for example from the spray head of a shower, can fall through the aperture into the cap. The weight of accumulated water above the body in the space enclosed by the cap could detach the body from the cap. To prevent that the water drainage channels 32 in the bottom part 24 permit water to drain away from the bottom face 30 and leak out between the cap and shoulder 24.

As can be seen from the drawings the part of the hook which follows the surface contour of the cap is not sufficiently rounded to provide a sure means of suspension for the container, particularly when the container is full. But with the provision of the part 40 of reduced radius this difficulty is disposed of.

The invention is not restricted to the above-described embodiment and many variations and modifications can be made.

I claim:

1. A container comprising a body having a top, a bottom and dispensing means on said top;

a cap having an outer surface and a substantially arcuate hook of a given radius attached thereto, said hook having a free end and a barb located adjacent said free end, said hook being movable between a first position wherein at least part of said hook extends along said outer surface of said cap, and a second position wherein the hook projects outwardly from the outer surface of said cap; and means for removably securing said cap on said top of said body and for removably securing said cap to said bottom of said body.

2. In the container of claim 1, said barb being substantially arcuate in shape, said barb having a smaller radius than that of said hook.

3. In the container of claim 1, said cap further including an aperture in the outer surface thereof, said barb extending through said aperture when said hook is in said first position.

4. In the container of claim 1, said means for removably securing said cap to said top and said bottom of said body comprising a first lip extending around said top of said body and a second lip extending around said bottom of said body, said first lip and said second lip being adapted for engaging with said cap to thereby hold said cap in place.

5. In the container of claim 1, said bottom including drainage means for draining water which may accumulate in said cap during use thereof.

6. In the container of claim 1, said cap and said hook including hinge means for hingeably connecting said hook to said cap.

7. In the container of claim 1, said hook including tab means for assisting in the movement of said hook from said first position to said second position.

8. A container comprising:

a body having a top, a bottom and dispensing means on said top;

a cap having an outer surface and a hook attached thereto, said hook being movable between a first position wherein at least part of said hook extends along the outer surface of said cap, and a second position wherein the hook projects from the outer surface of said cap, said cap further including means for releasably holding said hook in said first position; and means for removably fixing said cap on said top of said body to cover said dispensing means and for removably fixing said cap to said bottom of said body to suspend said body in an upside down position.

9. In the container of claim 8, said means for removably fixing said cap to said top and said bottom of said body comprising a first lip extending around said top of said body and a second lip extending around said bottom of said body, said first lip and said second lip adapted for engaging with said cap to thereby hold said cap in place.

10. In the container of claim 8, said bottom including drainage means for draining water which may accumulate in said cap during use thereof.

11. In the container of claim 8, said cap and said hook including hinge means for hingeably connecting said hook to said cap.

12. In the container of claim 8, said hook including tab means for assisting in the movement of said hook from said first position to said second position.

* * * * *